United States Patent [19]

Burr et al.

[11] 4,167,251

[45] Sep. 11, 1979

[54] LIFTER FOR ROCK CRUSHER LID

[75] Inventors: William F. Burr, Tigard, Oreg.; Neil M. Rose, Vancouver, Wash.; Stephen B. Ackers, Portland, Oreg.

[73] Assignee: Canica Crushers, Ltd., Vancouver, Wash.

[21] Appl. No.: 836,377

[22] Filed: Sep. 26, 1977

[51] Int. Cl.[2] ..... B02C 23/00

[52] U.S. Cl. ..... 241/285 A; 241/275

[58] Field of Search ..... 241/275, 285 R, 285 A, 241/285 B; 81/3 C, 3 D

[56] References Cited

U.S. PATENT DOCUMENTS

| | | | |
|---|---|---|---|
| 3,023,973 | 3/1962 | Conley et al. | 241/275 |
| 3,860,184 | 1/1975 | Acton | 241/275 |
| 3,955,767 | 5/1976 | Hise | 241/275 |

FOREIGN PATENT DOCUMENTS

| | | | |
|---|---|---|---|
| 2019384 | 11/1971 | Fed. Rep. of Germany | 241/285 A |

*Primary Examiner*—Howard N. Goldberg
*Attorney, Agent, or Firm*—Chernoff & Vilhauer

[57] ABSTRACT

Lifter for remotely removing the lid from a rock crusher is comprised of cylindrical support and lifting arms integrally joined normally to one another, and a tubular sleeve bearing which is attached generally vertically to the outer wall of the crusher shell a spaced distance therefrom, and which is configured for slideably and rotatably journaling the lifting arm. The support arm is attached to the lid thereby causing the lid to be lifted and rotated away from the crusher shell to expose the operative elements of the crusher upon respective lifting and rotation of the lifting arm. A hydraulically actuated piston cylinder mounted to the crusher frame below the lower end of the sleeve bearing, in a manner for insertion of its ram therein, is interconnected to the lifting arm through a thrust bearing for raising and lowering of the lifting arm and allowing its rotation in the sleeve bearing.

7 Claims, 3 Drawing Figures

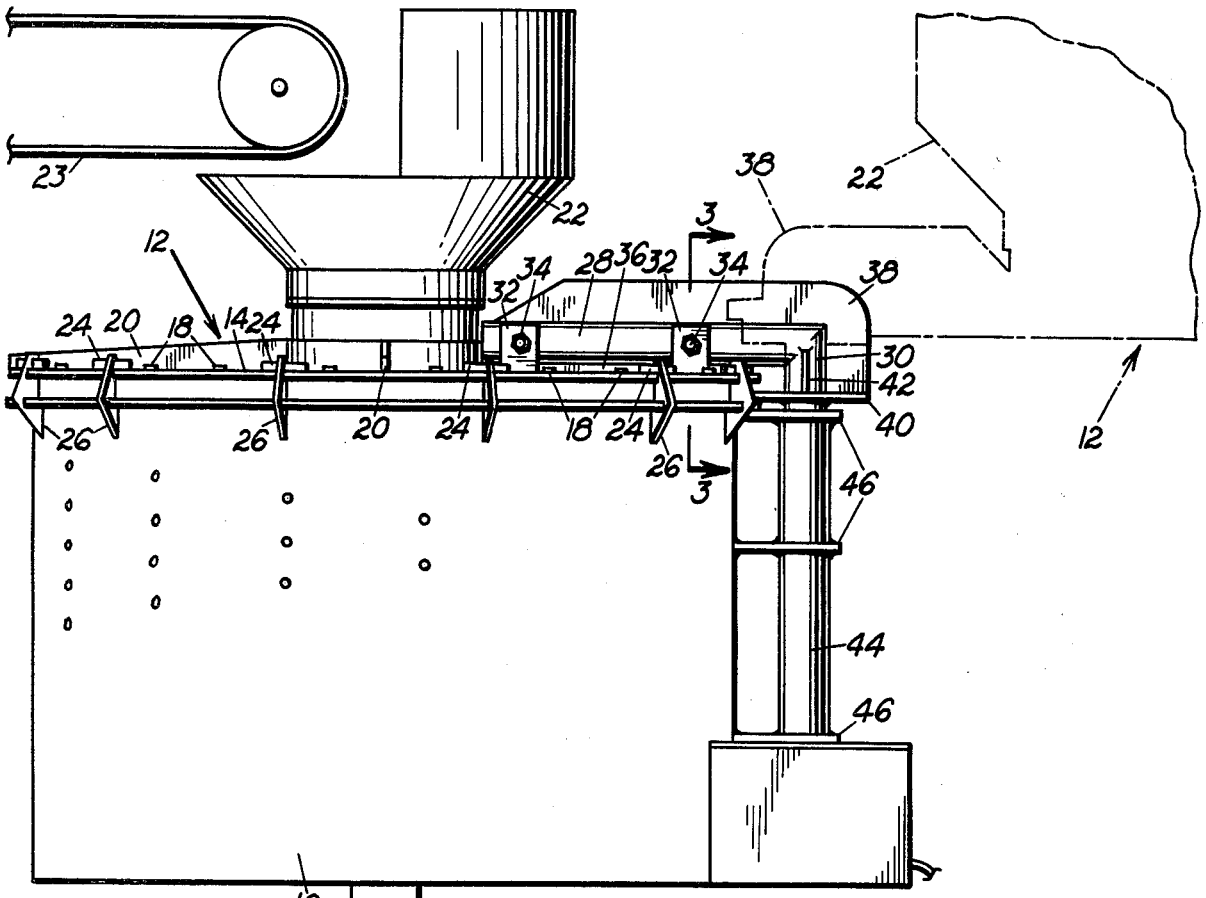
FIG. 1
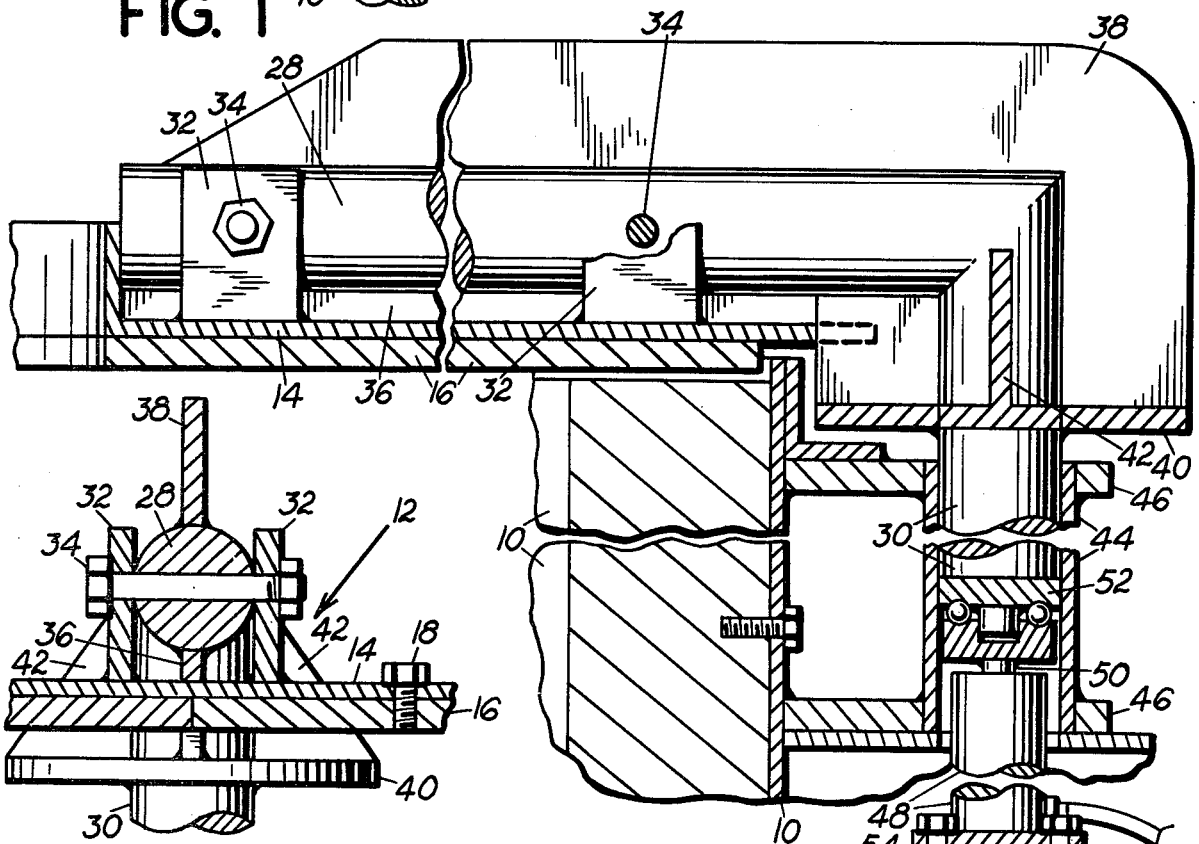
FIG. 3
FIG. 2

LIFTER FOR ROCK CRUSHER LID

BACKGROUND OF THE INVENTION

This invention relates to rock crusher construction, and more particularly to a lifter for remotely removing the lid from a rock crusher.

In rock crushers, particularly those of the centrifugal impact type, the operative elements of the crusher are surrounded by a cylindrical shell which in turn is covered by a removable lid in order to retain flying rock within an enclosed environment. Since crushers of this type are quite large and since the internal forces generated by the flying rock are high, the lids, along with the shell and other covering elements, are necessarily quite massive often weighing up to one ton. However, the lids must be removed frequently (anywhere from once a week to twice a day dependent on the material being crushed) in order to inspect and replace the operative elements of the crusher which are subject to rapid wear and frequent breakage due to the abrasive action of the rock material.

Accordingly, lifting equipment, such as a lift truck or front loader, must remain in waiting or else be on short notice for this purpose. In applications where the crusher is positioned well above ground level, a crane must be used for removing the lid thereby entailing large initial investment and operating costs. As a result the cost of the rock crushing operation is increased, and in many instances routine inspection for worn or broken parts is delayed or eliminated resulting in increased damage to the crusher and possible physical injury. In addition since the lid is reattached to the lifting device each time it is to be lifted, there is a likelihood of misrigging causing the raised lid to be dropped which also creates a safety hazard.

SUMMARY OF THE INVENTION

In order to overcome the aforementioned disadvantages of the prior art rock crushers, the present invention provides a remotely operated lid lifter which is integral with the crusher, comprising a cylindrical support arm which is connected to the lid, and a cylindrical lifting arm which is integrally joined substantially normal to the support arm in a manner to extend downwardly from the lid outwardly of the shell of the crusher. The lifting arm is slideably and rotatably journaled in a sleeve bearing which is connected to and supported by the crusher shell, and a hydraulically activated piston cylinder located within the sleeve bearing at its lower end is arranged to lift the lifting arm and thus the lid upon application of pressure. A thrust bearing interfaces the hydraulic cylinder ram and lifting arm so that the lifted lid can easily be rotated away from the shell to provide access to the operative elements of the crusher located therein.

It is a principal objective of the present invention to provide such a lid lifter wherein the lid can be removed and replaced quickly to minimize the loss of operating time associated with this operation.

It is a further objective of the present invention to provide such a lid lifter wherein the lid is supported positively when in a raised position in order to eliminate the possibility of accidentally dropping of the lid when it is removed from the crusher.

It is a further objective of the present invention to provide such a lid lifter which does not require any aid from external lifting devices.

It is a still further objective of the present invention to provide such a lid lifter which positively joins the lid to the crusher shell when in its closed position to prevent its being blown off in the event of failure of internal crusher components.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 1 is a side elevational view showing a preferred embodiment of the lid lifter of the present invention, with the lid partially illustrated in its removed position in phantom line.

FIG. 2 is a detailed view, at an increased scale and foreshortened, of a portion of the lid lifter shown in FIG. 1.

FIG. 3 is a sectional view taken on the line 3—3 of FIG. 1.

DETAILED DESCRIPTION OF A PREFERRED EMBODIMENT

Referring to FIG. 1 of the drawings, the lifter of the present invention is configured for removing the lid from a centrifugal impact rock crusher. Crushers of this class have an outer shell 10, generally cylindrical, which encloses the operative elements of the crusher, and a circular lid 12 which covers the open upper end of the shell. The lid, which may weigh up to a ton, includes a planar steel plate 14 having replaceable wear resistant liners 16 (FIG. 2) attached to its inner surface by means such as bolts 18. The lid is stiffened by webs 20 which are integrally joined to its upper surface, and a funnel 22 fits into a medial opening in the lid (not shown) for loading rock into the crusher from a conveyor belt 23. The lid is secured to the shell by suitable means, such as by driving wedges 24 into openings (not shown) in flanges 26 which in turn fit through slots in the lid. The resulting lid therefore is massive and extremely difficult to maneuver onto and off of the shell.

The lifter, best shown in FIGS. 2 and 3, comprises a cylindrical support arm 28 which is integrally joined at a substantially right angle to a like dimensioned cylindrical lifting arm 30. Support arm 28 is mounted generally parallel to the upper surface of the lid in a manner such that lifting arm 30 extends downwardly past the periphery of the lid. The support arm is attached, by means of bolts 34, to two sets of spaced apart flanges 32 which are joined to the lid. A spacer bar 36 fits between the support arm and the lid to provide clearance for removal of bolts 18 without removal of the lid from the lid lifter.

The support and lifting arms are strengthened by a first stiffener 38 which is rectangular in cross section and which extends over the entire extent of the upper surface of the support arm and over the upper portion of the outside surface of the lifting arm. The first stiffener is integrally joined to the support and lifting arms and to a second, annular shaped, stiffener 40 which also is joined to the lifting arm. In addition third stiffeners 42, which are triangular in shape, interconnect second stiffener 40 and the lifting arm on each side at locations 90° from the first stiffener.

The lifting arm is carried slideably and rotatably in a hollow cylindrical sleeve bearing 44 which is attached generally vertically to the outer wall of shell 10, a short distance outwardly thereof, by three equally spaced brackets 46 which are integrally attached to the shell. Sleeve bearing 44 is arranged to receive the lifting arm in a snug sliding fit allowing it to be rotated or linearly translated therein, while supporting it over its entire length against cocking due to angular loading. If desired a machined liner and lubrication means (not shown) can be installed inside sleeve bearing 44 for this purpose.

Mounted within sleeve bearing 44 at its lower extremity, is reciprocative actuation means, such as hydraulically operated piston cylinder 48, for raising lifting arm 30 and thus the lid. The ram 50 of piston cylinder 48 interfaces the lifting arm through a thrust bearing 52, thereby allowing rotation of the lifting arm in sleeve bearing 44 while it is being lifted by piston cylinder 48 for rotating the lifted lid away from the top of shell 10 to expose the operative elements of the crusher. The piston cylinder illustrated is of the single acting type since the weight of the lid effectuates its being lowering without hydraulic assistance, and it is attached rigidly to the crusher frame 54 by bolts 56. In the embodiment shown pressurized hydraulic fluid is provided to the piston cylinder from an external pump and control unit (not shown), although, alternately a self contained pump could be provided.

In operation, lid 12 is released from shell 10 by removing wedges 24. Then upon activation of piston cylinder 48 ram 50 is extended, thereby raising lifting arm 30 in sleeve bearing 44. Since the lid is interconnected to the lifting arm through support arm 28 it is also lifted upwardly off of the shell. The lid can then be manually rotated away from the shell to the position shown by the phantom lines in FIG. 1, exposing the operative elements of the crusher for inspection, repair or replacement. Thrust bearing 52, which interfaces the piston cylinder ram and the lifting arm allows ease of rotation of the latter element in sleeve bearing 44.

After servicing the crusher, the lid is replaced by rotating it back into place over the shell and lowering it by slowing releasing the pressure to the piston cylinder. When seated the lid again is locked by driving wedges 24 into the opening in flanges 26 thereby readying the crusher for further operation.

The terms and expressions which have been employed in the foregoing abstract and specification are used therein as terms of description and not of limitation, and there is no intention in the use of such terms and expressions, of excluding equivalents of the features shown and described or portions thereof, it being recognized that the scope of the invention is defined and limited only by the claims which follow.

What is claimed is:

1. A remotely operated lifter for removing the lid of a rock crusher of the type having an exterior shell and a lid removably enclosing the open upper end of said shell, the lifter comprising:

(a) a support arm removably attached to said lid, and extending outwardly thereof;

(b) a lifting arm joined to said support arm outwardly of said crusher shell;

(c) sleeve bearing means journaling said lifting arm in a manner for raising and lowering of said lid from said crusher shell upon appropriate translation of said lifting arm in said sleeve bearing means and for rotation of said lid with respect to said crusher shell upon rotation of said lifting arm in said sleeve bearing means;

(d) reciprocative actuation means located within said sleeve bearing means and operatively associated with said lifting arm in a manner for translating said lifting arm with respect to said sleeve bearing means; and (e) thrust bearing means located within said sleeve bearing means and interconnecting said reciprocative actuation means and said lifting arm, for allowing rotation of said lifting arm relative to said reciprocative actuation means while said lift lid is being lifted.

2. The lifter of claim 1 wherein said support and lifting arms are comprised of cylindrical elements integrally joined at right angles to one another.

3. The lifter of claim 2 wherein the sleeve bearing means comprises a hollow cylindrical tube arranged to slideably and rotatably receive said lifting arm.

4. The lifter of claim 2 including a first stiffener integrally attached to said support arm at the end thereof opposite said lid, and to a portion of the lifting arm adjacent to said support arm.

5. The lifter of claim 5 further including a second stiffener, having an annular shape, encircling said lifting arm adjacent to the extremity of said first stiffener, and integrally attached to said lifting arm and to said first stiffener.

6. The lifter of claim 6 further including paired third stiffeners integrally interconnecting said second stiffener and said lifting arms substantially normal to said first stiffener.

7. The lifter of claim 1 wherein the reciprocative actuation means comprises a hydraulically operated piston cylinder.

* * * * *

UNITED STATES PATENT AND TRADEMARK OFFICE

CERTIFICATE OF CORRECTION

PATENT NO. : 4, 167,251

DATED : September 11, 1979

INVENTOR(S) : William F. Burr et al

It is certified that error appears in the above–identified patent and that said Letters Patent are hereby corrected as shown below:

Col. 4, Line 40 Change "claim 5" to --claim 4--;

Col. 4, Line 45 Change "claim 6" to --claim 5--.

Signed and Sealed this

*Fifth* Day of *February 1980*

[SEAL]

*Attest:*

SIDNEY A. DIAMOND

*Attesting Officer*

*Commissioner of Patents and Trademarks*